US005784956A

United States Patent [19]

Walz

[11] Patent Number: 5,784,956

[45] Date of Patent: Jul. 28, 1998

[54] APPARATUS FOR PRINTING MATERIALS PARTICULARLY TEXTILE MATERIALS CERAMICS PAPER OR THE LIKE

[76] Inventor: Heinz Walz, Oberhaldenweg 38, 72793 Pfullingen, Germany

[21] Appl. No.: 865,785

[22] Filed: Aug. 7, 1997

[30] Foreign Application Priority Data

May 30, 1996 [DE] Germany ..... 196 22 230.3

[51] Int. Cl.[6] ..... B41F 15/04

[52] U.S. Cl. ..... 101/115; 101/123; 101/126

[58] Field of Search ..... 101/114, 115, 101/116, 123, 126

[56] References Cited

U.S. PATENT DOCUMENTS

| | | | |
|---|---|---|---|
| 3,871,293 | 3/1975 | Valiela | 101/114 |
| 4,493,254 | 1/1985 | Landesmann et al. | 101/115 |
| 5,228,108 | 7/1993 | Motev et al. | 101/114 |
| 5,239,613 | 8/1993 | Motev et al. | 101/115 |
| 5,313,882 | 5/1994 | Karlyn et al. | 101/115 |
| 5,438,922 | 8/1995 | Bubley et al. | 101/115 |
| 5,490,456 | 2/1996 | Richardson et al. | 101/115 |
| 5,626,074 | 5/1997 | Zelko | 101/115 |

*Primary Examiner*—Eugene H. Eickholt

[57] ABSTRACT

An apparatus for printing materials, particularly textile materials, ceramics, paper or the like, has a housing and a drive apparatus, with several printing units, which are respectively associated with a pallet arranged on a pallet carrier and with a rotary drive which receives the pallets and which transfers the pallets into a succeeding processing station, and with a plate which carries the printing units and which can be moved up and down with a lifting apparatus, wherein the rotary drive is constructed as an indexing table with a rotary plate and can be indexed electromechanically.

16 Claims, 3 Drawing Sheets

APPARATUS FOR PRINTING MATERIALS PARTICULARLY TEXTILE MATERIALS CERAMICS PAPER OR THE LIKE

A "VARIPRINT" screen printing machine of Firma Schenk GmbH is already known for printing textile materials, ceramics, paper, plastics, glass or the like, and is constructed as a rotary machine. A rotary plate is rotatably mounted on a housing, and by means of pallet carriers receives pallets to receive the materials to be printed. A printing unit is arranged above the pallets, on a plate which is fixedly attached to the housing. The pallet and the printing unit form a printing station. In the usual case, there are present, on such a screen printing apparatus, eight pallets on a six-color machine, and for example sixteen pallets on a fourteen-color machine or a fourteen-station machine. The two pallets without printing units serve for loading and for removal of the materials to be printed.

In such machines, the printing unit is lowered during the printing process, so that a liquid medium, usually ink, is applied to the surface of the material to be printed by means of a doctor blade system. After the printing process, lifting away of the screen printing stencils or of the printing units, and an onward rotation of the pallets, are effected so that the next printing process can take place. The rotary plate which receives the pallets is driven by a servo motor and a toothed belt, in order to make possible an onward stepping of the pallets, or a positioning of the pallets at the next printing station. Positioning in the correct location takes place by means of a mechanical indexing system. Pins are provided on the rotary plate, and are directed toward the plate carrying the printing units, to engage in a free space between two rollers arranged on the plate when the printing units are lowered by a lifting device, so that a positioning of the printing units in a correct location with respect to the pallets is obtained.

With a motif to be printed which consists of one or more colors, it is required that an exact positioning of the individual motif components relative to each other takes place with an accuracy of less than 0.25 mm, so that the different colors of the individual motif components border on each other exactly and a clean print is made possible, without overlapping or excessive spacing apart of the individual components relative to each other. In order to attain this with a servo motor, very costly controls are required. Also, the capacity of the servo motor is limited. Furthermore, precise positioning is made difficult by driving the rotary plate by means of a toothed belt, since this is constructed to be at least slightly elastic, and exact positioning is possible only with difficulty, particularly during braking of the rotary motion, because of the inertia of the rotary plate or of the large moving masses. It is furthermore required to attach a mechanical indexing system to each processing station, so that the production of such screen printing machines is very expensive in their assembly, in order to be able to keep the sum of the possible tolerances small. Furthermore, a slow lowering of the printing stations is required, in order to introduce the pin into the free space between the rollers. The minimum cycle time for the printing of materials is thereby limited.

SUMMARY OF THE INVENTION

The invention therefore has as its object to provide an apparatus by which a simple arrangement and design of a rotary drive at a favorable cost, and thus an exact positioning of the pallets relative to the printing unit, is made possible, and in which the handling, receiving and accessibility of the screen printing stencils through the printing units is improved, and a rotary securement of the printing units to the housing is insured.

This object is achieved by a rotary drive constructed as an indexing table with a rotary plate having a working cycle in which the pallet is received at a processing station and transferred to a next processing station under control of an electromechanical indexing system that senses and positions the pallet. By the use of an indexing table as the rotary drive, with a rotary plate which is preferably driven by a three-phase braking motor, and with an electromechanical indexing system which can interrogate and detect the amount of rotary motion, it is made possible to obtain a rapid positioning of the pallets from one printing unit to the next. The working cycle can be reduced by this means to as little as 0.8 seconds, so that an increase of performance or a rise in productivity can be simultaneously obtained. Because of the electromechanical indexing system which is integrated with the rotary drive, costly assembly work, which was necessary with the mechanical indexing systems of the prior art, is no longer required. Moreover, an accuracy of registration of at least 0.025 mm can be attained by the use of the rotary drive with electromechanical indexing with an operating cam, and with a transducer cooperating with this.

To increase the printing accuracy, it is furthermore advantageous to provide a rotation securement, which is arranged on a lifting column connecting the lifting device with the plate. The rotation securement is guided in a guide on the housing. Thereby, once a printing unit has been accurately set with respect to a processing station, the accuracy can be correctly maintained, independently of possible effects on the lifting column, and thus on the printing unit, due to the lifting motions. According to an advantageous embodiment, it is provided that the rotation securement engages the yoke on the guide column by means of a clamp connection. It can also be advantageously provided that the lifting columns have a flat in the region of the working surface of the yoke, so that an additional rotation securement can be achieved due to the clamping.

According to a further advantageous embodiment of the invention, it is provided that the free ends have guide rollers transversely of the longitudinal axis of the yoke and guided between two mutually parallel spaced-apart rails. Large lever arms can act by means of this embodiment, so that a secure and correctly located positioning of the plate, and of the printing units arranged thereon, is obtained, and so that a high registration accuracy can be attained, independently of torques which act on the housing via the rotary drive or the pallets.

It is furthermore provided, according to the invention, that the printing unit has a cantilever arm, on which there are provided, arranged at right angles thereto near its right-hand and left-hand ends, a right-hand and a left-hand frame, to receive screen printing stencils. This portal form of arrangement has the advantage that an easy and rapid change of screen printing stencils is made possible, in which locking screws are released from a screen printing stencil holders arranged on the frame. This arrangement furthermore has the advantage that the right-hand or left-hand frames are arranged to be movable relative to each other, so that rapid matching to different sizes of screen printing stencils is made possible.

According to a further advantageous embodiment of the printing unit, arranged in a portal form, it is provided that a double-action stroke cylinder is provided parallel to the cantilever arm, and moves a doctor blade system back and forth longitudinally with respect to the cantilever arm. A compact construction can thereby be attained.

According to a further advantageous arrangement of the frame, it is provided that the cantilever arm is constructed as a hollow profile. The supply ducts can thus pass through within a hallow profile, so that they are protected from damage and improper handling. Such supply ducts can conduct both the printing medium and also compressed air for the pneumatic cylinders.

BRIEF DESCRIPTION OF THE DRAWINGS

Further advantageous arrangements and developments of the invention are given in the specification, in the patent claims, and in the drawings.

A preferred embodiment example is shown in the drawings.

DETAILED DESCRIPTION OF PREFERRED EMBODIMENTS

Figure 1:
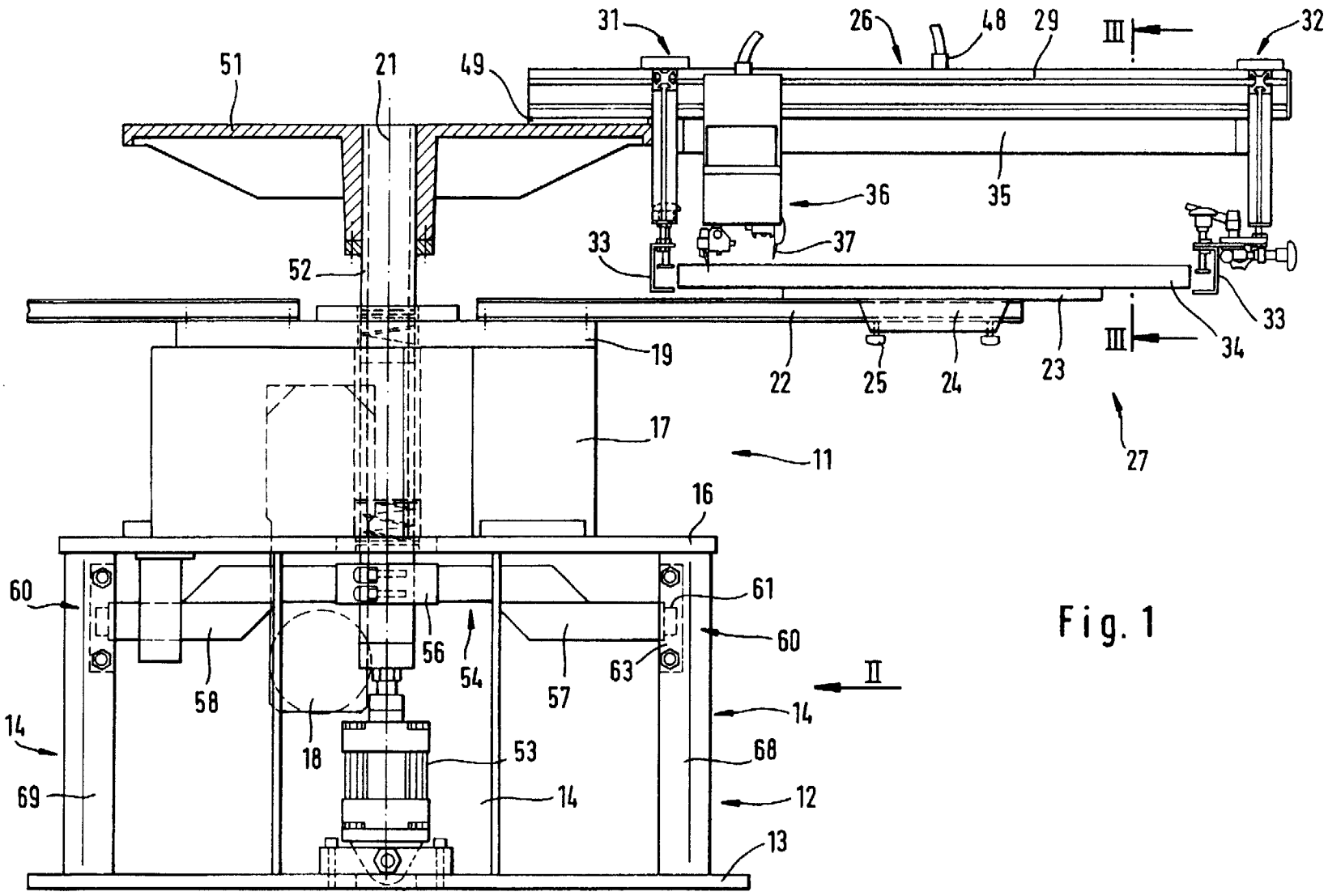
FIG. 1 shows a schematic side view of a screen printing apparatus.
Figure 2:
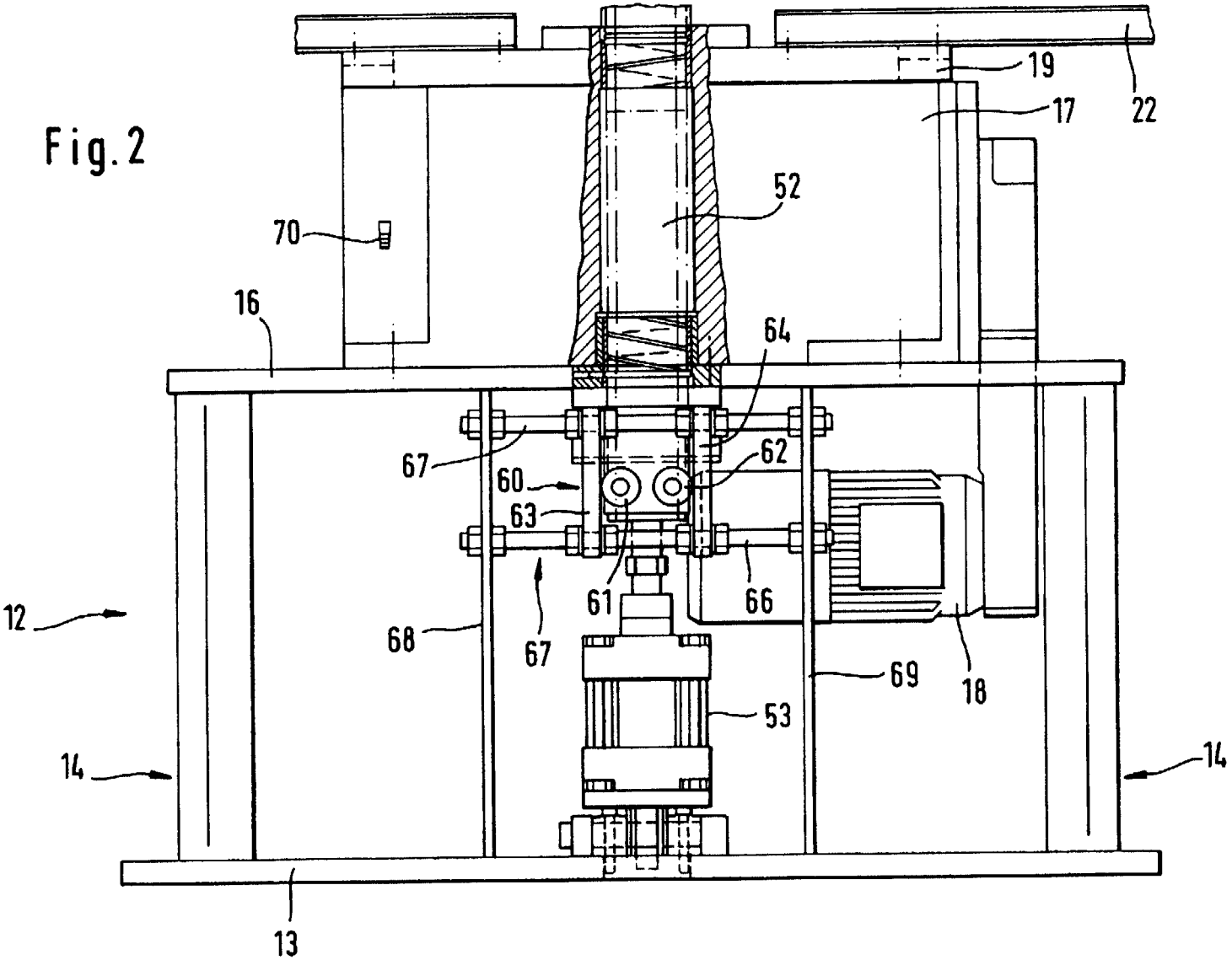
FIG. 2 shows a schematic side view according to the direction of the arrow II in FIG. 1.

An apparatus 11 for printing materials, particularly textile materials, is illustrated in FIG. 1. A housing 12 has a baseplate 13 which carries a cover plate 16 by means of vertical columns 14. A rotary drive 17 is attached to the cover plate 16, and is electrically driven by means of a drive motor 18. The drive motor 18 drives, via a gear (not shown), a rotary plate 19 which is mounted for rotation around the longitudinal axis 21. Pallet carriers 22 are arranged radially on the rotary plate 19, and each carries a pallet 23 at its respective free end. The pallet 23 has on its underside a guide shoe 24 which engages around the pallet carrier 22. The pallet 23 can be attached to the pallet carrier 22 by means of a screw clamp connection 25 arranged on the guide shoe 24.

The pallet 23 and a printing unit 26 form a printing station 27. The printing unit 26 has a cantilever arm 29 which runs substantially horizontally, with a left-hand and right-hand frame 31, 32. The frames 31, 32 respectively carry a screen printing stencil holder 33 which can receive a screen printing stencil 34. A double-action stroke cylinder 34A is arranged on the cantilever arm 29, and moves a doctor blade system 36 back and forth along the cantilever arm 29, in order to move the doctor blade 37 back and forth over the screen printing sheet, so that the respective material is printed.

Figure 3:
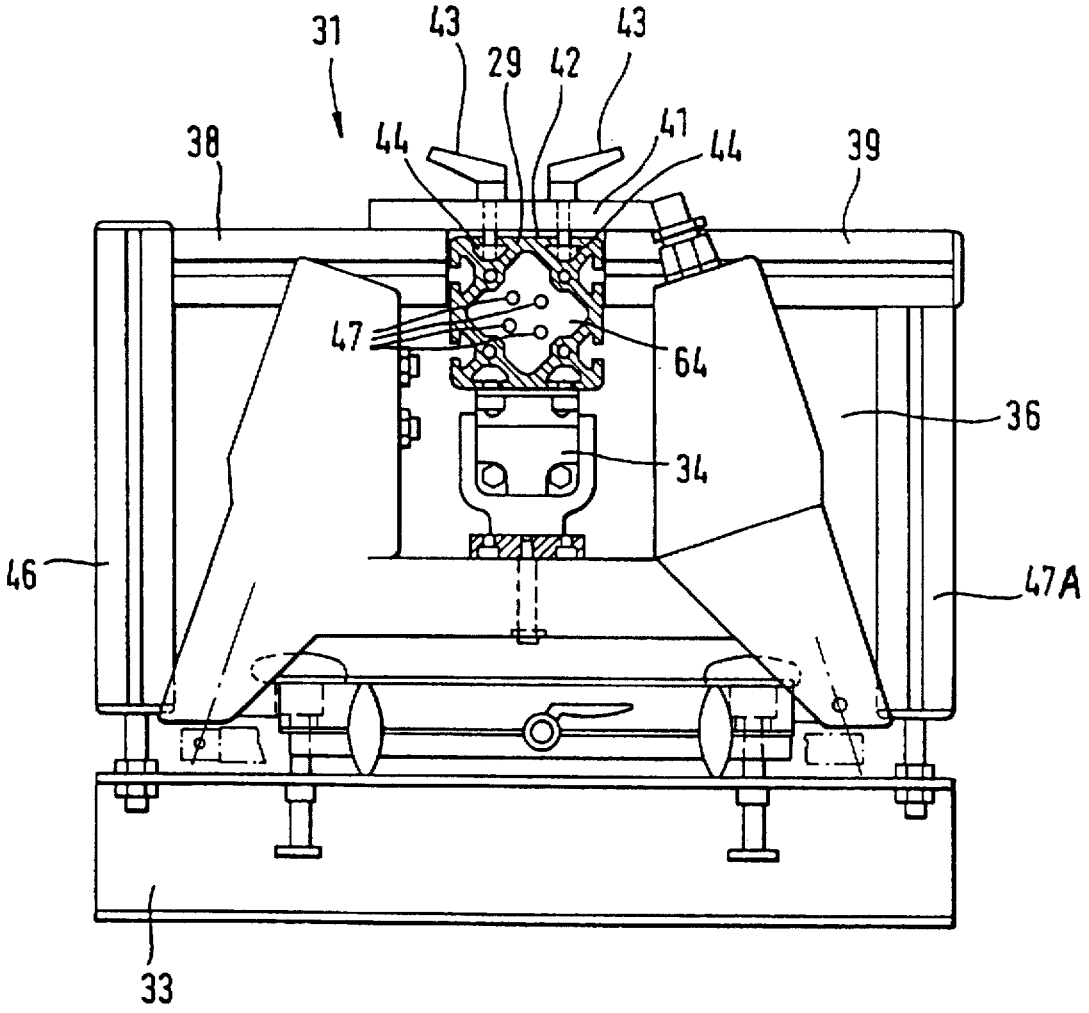
FIG. 3 shows a sectional illustration along the line III—III in FIG. 1.

The frames 31, 32, as shown in more detail in FIG. 3, are constructed of profile elements which can be connected together by a screw connection. Sections 38, 39 are provided, arranged horizontally to left and right of the cantilever arm, with their ends which face each other facing toward the side surfaces of the cantilever arm 29. The sections 38, 39 are connected together by a plate 41, which abuts on an upper side 42 of the cantilever arm 29. The plate 41 can be attached to the cantilever arm 29 by means of a screw connection 43, with a respective sliding block engaging in a groove 44. This releasable clamp connection makes it possible for the frames 31, 32 to be adjustable to different sizes of the screen printing stencils 34. Struts 46, 47A are arranged adjoining the sections 38, 39 at right angles, and carry the screen printing stencil holders 33 at their free ends. An about rectangular frame 31, 32 is thus obtained, having a size which is determined by the doctor blade system 36 carried by the stroke cylinder 34, or its height. The stroke cylinder 34 can likewise be attached by means of a hammer-head bolt which engages in the groove 44 of the cantilever arm 29, which is constructed as a hollow profile.

The cantilever arm 29 with its grooved hollow profile has the advantage that a simple fitting of add-on parts, and a simple mounting with series production components, are obtained. Furthermore the hollow profile has the advantage that supply ducts 47 are passed through a core hole bore 64 of the cantilever arm 29. Firstly, a pneumatic duct is provided, to supply the stroke cylinder 34 with compressed air. Furthermore, supply ducts 47 are provided for the doctor blade system 36 in order to supply this with liquid medium, preferably dye. In an advantageous manner, these supply ducts emerge from an opening 48 in a middle region of the cantilever arm 29 and, sheathed by a protective flexible tube, lead to the doctor blade system 36.

A mounting plate 49 or adapter plate is provided at one free end of the cantilever arm 29, and can be fastened on one side to the grooved profile of the cantilever arm 29 and on the other side to a plate 51. Eight processing stations with eight pallets 23 and six printing units are provided, mutually spaced apart, in a six-color apparatus 11. The pallets 23 are radially attached, uniformly spaced apart, to the rotary plate 19. The printing units 26 are positioned to six pallets 23 which follow one another, so that two adjacently located pallets 23 are free for removal and for loading.

The plate 51 is carried by a lifting column 52 and is arranged non-rotatably attached to the housing 12. The lifting column 52 passes through the rotary drive 17 along the longitudinal axis 21 and is carried by a stroke cylinder 53. The lifting cylinder 53, for its part, is attached to the baseplate 13.

A rotation securement device 54, which is constructed as a yoke, is provided in the housing 12. A clamp connection 56, which engages around the lifting column 52, is provided in the middle region of the yoke. Arms 57, 58 extend left and right of the clamp connection 56, and carry at their free ends guide rollers 61, 62 which are guided in a left and right guide 60. The axes of rotation of the guide rollers 61, 62 are arranged parallel to the longitudinal axis of the rotation securement 54. The guide rollers 61, 62 can thus be guided on two mutually parallel rails 63, 64. By means of spacers 66, 67, these rails 63, 64 are adjustably held to a respective left-hand and right-hand strut 68, 69, which are separate, or which preferably form a portion of the column. The stroke cylinder 53 has a stroke of about 15 mm. The rails 63, 64 are constructed at least slightly larger than the stroke length.

The screen printing machine operates as follows. The screen printing apparatus 11 is constructed as, for example, a six color machine. This means that six printing stations and two free pallets 23 are provided, that is, eight stations in all.

After the free pallet 23 has been loaded with material to be printed, current is supplied to the rotary drive 17, which is constructed as a three-phase braking motor, and the pallet 23 is stepped to a first printing station. The path distance can be determined precisely by means of an electromechanical indexing system 70 of the rotary drive 17, so that, after having traveled over a given angle or a division, the rotary table 19 is braked by means of the three-phase braking motor, and is positioned exactly. Positioning of less than two and a half tenths of a millimeter can be attained by the electromechanical indexing system 70, so that the accuracy of registration is satisfied. This stepping-on can take place in a cycle of less than 1 second by means of the index table with a three-phase braking drive, which is used according to the invention. In the electromechanical indexing system, control takes place by means of an operating cam which carries out one revolution, and which has a partial section which has a dead point, or is constructed, such that the indexing table stays stationary for the printing. A tracking means engages the operating cam, and is connected to an electrical sensor. An exact positioning and a rapid cycle time can thereby be attained. The operating cam carries out one revolution per cycle; the indexing table is thereby stepped over the periphery according to the division.

After the pallet 23 has reached its working position, the lifting cylinder 53 is lowered, so that the screen printing stencil 34 is in contact with the material to be printed. The printing process can be carried out in the manner already known in the prior art. The lifting cylinder 53 is then acted on with compressed air, transferring the printing units 26 to an upper position. The rotary drive 17 begins again to step the pallets 23 on into the next processing station.

Rapid and simple assembly can take place because of the use, according to the invention, of indexing tables with an electromechanical indexing system, and in addition, high positioning accuracy at high cycle rates is made possible.

I claim:

1. Apparatus for the printing of materials, with a housing (12) and several printing units (26) which are respectively associated with a pallet (23) arranged on a pallet carrier (22) and with a rotary drive (17) which receives several pallets (23) and transfers the pallets (23) to a next processing station, and with a plate (51) which carries the printing units (26) and can be moved up and down by means of a lifting apparatus (53), characterized in that the rotary drive (17) is constructed as an indexing table with a rotary plate, having a working cycle in which a pallet is received at a processing station and is transferred to a next processing station under control of an electromechanical indexing system that senses and positions the pallet.

2. Apparatus according to claim 1, characterized in that the rotary drive (17) has an electric three-phase braking motor.

3. Apparatus according to claim 1, characterized in that an operating cam has a dead point in an indexed position in which the indexing table stands still, and that after passing through the dead point a further transfer by the indexing table is provided.

4. Apparatus according to claim 1, characterized in that the number of pallets (23) determines the division of the apparatus into processing stations.

5. Apparatus according to claim 1, characterized in that the rotary drive (17) has a cycle time of less than one second for a working cycle of the pallets (23) into a next succeeding processing station.

6. Apparatus according to claim 1, characterized in that between the lifting apparatus (53) and the plate (51) which receives the printing units (26), a lifting column (52) is provided and is engaged by a rotational securement apparatus (54) which is received by at least one end in a guide (60) of the housing (12).

7. Apparatus according to claim 6, characterized in that the rotational securement apparatus (54) is constructed as a yoke which engages with a clamp connection (56) on the lifting column (52) and which is guided in the guide (60) by a left-hand and a right-hand arm (57, 58).

8. Apparatus according to claim 7, characterized in that guide rollers (61, 62), whose axes of rotation run parallel to the longitudinal axis of the rotational securement apparatus (54), are provided at the free ends of the arms (57, 58).

9. Apparatus according to claim 6, characterized in that the guide (60) is formed by two mutually parallel, spaced-apart rails (63, 64), which are adjustable by spacers (66, 67) to struts (68, 69) of the housing (12).

10. Apparatus according to claim 1, characterized in that the printing unit (26) includes a cantilever arm (29) which runs substantially horizontally, with a left-hand frame (31) and right-hand frame (32), which respectively carry a screen printing stencil holder (33).

11. Apparatus according to claim 10, characterized in that the printing unit (26) has a stroke cylinder (34) arranged parallel to the cantilever arm (29) and driving a doctor blade system (36) reciprocably.

12. Apparatus according to claim 11, characterized in that the stroke cylinder (34 A) is constructed as a double-acting stroke cylinder.

13. Apparatus according to claim 10, characterized in that the cantilever arm (29) is constructed as a grooved hollow profile.

14. Apparatus according to claim 13, characterized in that supply ducts (47) are arranged in a core hole bore (46) of the cantilever arm (29).

15. Apparatus according to claim 10, characterized in that the frames (31, 32) can be matched to the length of a screen printing stencil (35) received by said screen printing stencil holder (33) with a quick coupling system engaging in the grooves of the cantilever arm (29).

16. Apparatus according to claim 10, characterized in that the frames (31, 32) which carry said screen printing stencil holder (33) have two vertical profile struts (46, 47 A) which engage on the screen printing stencil holder (33), and which are respectively received by a cantilever arm (29) arranged at right angles thereto, and two vertical sections, (38, 39) the ends of said sections (38, 39) being arranged toward each other and attachable to the cantilever arm (29).

* * * * *